US010575606B2

(12) United States Patent
Winderl et al.

(10) Patent No.: US 10,575,606 B2
(45) Date of Patent: Mar. 3, 2020

(54) ELONGATE DECORATIVE ELEMENT WITH REDUCED SURFACE ROUGHNESS

(71) Applicant: D. Swarovski KG, Wattens (AT)

(72) Inventors: Kurt Winderl, Vomperbach (AT); Franz Kaltenecker, Jenbach (AT)

(73) Assignee: D. Swarovski KG, Wattens (AT)

( * ) Notice: Subject to any disclaimer, the term of this patent is extended or adjusted under 35 U.S.C. 154(b) by 0 days.

(21) Appl. No.: 16/078,768

(22) PCT Filed: Nov. 29, 2016

(86) PCT No.: PCT/EP2016/079109
§ 371 (c)(1),
(2) Date: Jan. 9, 2019

(87) PCT Pub. No.: WO2017/144133
PCT Pub. Date: Aug. 31, 2017

(65) Prior Publication Data

US 2019/0125043 A1 May 2, 2019

(30) Foreign Application Priority Data

Feb. 26, 2016 (EP) ..... 16157633

(51) Int. Cl.

| | |
|---|---|
| ***A44C 17/04*** | (2006.01) |
| ***A44C 17/00*** | (2006.01) |
| ***A44C 27/00*** | (2006.01) |
| *A44C 5/00* | (2006.01) |
| *A44C 15/00* | (2006.01) |
| *A45C 13/08* | (2006.01) |

(52) U.S. Cl.
CPC ..... *A44C 17/04* (2013.01); *A44C 17/008* (2013.01); *A44C 27/00* (2013.01); *A44C 27/001* (2013.01); *A44C 5/00* (2013.01); *A44C 15/005* (2013.01); *A45C 13/08* (2013.01)

(58) Field of Classification Search
CPC ..... A44C 17/04
USPC ..... 428/67
See application file for complete search history.

(56) References Cited

FOREIGN PATENT DOCUMENTS

| | | | | |
|---|---|---|---|---|
| CN | 102885441 | A | 1/2013 | |
| CN | 203597499 | U | 5/2014 | |
| CN | 106363534 | A | 2/2017 | |
| CN | 206718847 | U | 12/2017 | |
| DE | 4218498 | A1 * | 12/1993 | ..... A44C 17/04 |
| DE | 4218498 | A1 | 12/1993 | |
| EP | 1295984 | A2 | 3/2003 | |
| EP | 2135749 | A2 | 12/2009 | |

(Continued)

OTHER PUBLICATIONS

Sophia Kruger; Extended European Search Report; European Application No. 16157633.5; dated Aug. 18, 2016; European Patent Office; Germany.

(Continued)

*Primary Examiner* — Brent T O'Hern
(74) *Attorney, Agent, or Firm* — Stevens & Showalter, L.L.P.

(57) ABSTRACT

The invention relates to a decorative element comprising an elongate support body and a multitude of, in particular faceted, gemstones on an adhesive layer on the support body, wherein a minimum position and a maximum position exist for each of the gemstones.

20 Claims, 8 Drawing Sheets

(56) References Cited

FOREIGN PATENT DOCUMENTS

WO 2008146755 A1 12/2008

OTHER PUBLICATIONS

Sophia Kruger; International Search Report and Written Opinion of the International Search Authority; International application No. PCT/EP2016/079109; dated Feb. 2, 2017; European Patent Office; Rijswijk, Netherlands.
First Office Action; Chinese Patent Application No. 201611208866.7; dated Sep. 25, 2019; The State Intellectual Property Office of People's Republic of China; Beijing, China.

* cited by examiner

ELONGATE DECORATIVE ELEMENT WITH REDUCED SURFACE ROUGHNESS

FIELD OF THE INVENTION

The invention relates to a decorative element comprising an elongate support body and a multitude of, in particular faceted, gemstones on an adhesive layer on the support body, wherein a minimum position and a maximum position exist for each of the gemstones.

The invention further relates to a process for producing a decorative element with an elongate support body and a multitude of gemstones provided on the support body, comprising the steps of applying a layer of adhesive to the surface of the support body and distributing a multitude of gemstones on the surface of the support body.

The decorative elements according to the invention are suitable for preparing a wide variety of fashion accessories and jewels.

BACKGROUND ART

In the fashion and design industry, it is common to decorate clothes, handbags or other accessories with gemstones. It is essential to the application of the gemstones that at least part of the gemstone surface is provided with adhesive, and that the gemstones are directly applied. However, if it is intended to provide large areas with a multitude of gemstones, or if the gemstones are very small and difficult to handle, it is extremely cumbersome and also expensive to apply the gemstones manually, for example, with liquid hotmelt adhesive, and to attach them at the desired place.

To avoid these problems, it is known to attach the gemstones first to a transfer medium and then to apply the latter to a piece of clothing or fashion accessory. In EP 1 295 984 A2, a film coated with a hotmelt adhesive is shown, wherein glass beads and faceted glass elements are impressed into the molten layer in large areas on the film. The disadvantage is that such films provided with gemstones can be applied only to objects having an essentially planar surface. In addition, the film itself can prove visually less appealing, or to be difficult to attach to the respective object.

EP 2 135 749 shows a decorative element with a multitude of gemstones provided on an elongate support body. The gemstones are applied to the support body through a pouring device, after the support body has been provided with an adhesive layer. It is disadvantageous that the gemstones, which often have a sharp corner, end up on the support body disorderly, and in part also in several layers on top of one another. Thus, a covering with gemstones is not possible without the gemstones touching each other in the attached state and may be damaged when the support body is moved. On the one hand, this is considered unaesthetic, and on the other, a poor adhesion and a roughness that feels uncomfortable are associated with it. In addition, the protruding sharp corners of the gemstones present a potentially increased risk of injury.

DE 42 18 498 A1 discloses a gemstone made of a thermoplastic material to be applied to sheet textiles, such as garments and bags, by adhesive bonding, wherein said bonding is effected by a thermally activatable adhesive that can be combined with a thermoblocker.

It is the object of the invention to provide a decorative element comprising a multitude of gemstones held by an adhesive layer that avoids the above mentioned drawbacks and enlarges the field of application of the above inventions.

The invention further relates to a process for producing the decorative element according to the invention.

DESCRIPTION OF THE INVENTION

The object is achieved by a decorative element having the features of claim 1 or of the dependent claims, and by a process having the features of claim 11 or of the dependent claims.

For each of the multitude of gemstones held by an adhesive layer spread on the elongate support body, there is a minimum position H min and a maximum position H max. In the minimum position H min, the height of the gemstone relative to the surface of the support body is minimal, while in the maximum position H max, the height of the gemstone relative to the surface of the support body is maximal. For gemstones with no spherical symmetry, the minimum position and the maximum position are different. In this case, "height" means the largest distance of the gemstone from the surface of the support body, i.e., the maximum of all normal distances of all points of the gemstone. In the case of a curved surface, such as the lateral surface of a cylinder, the height of the gemstone relative to the surface of the support body relates to a tangential plane placed against the surface of the support body in the point in which the gemstone contacts the support body or comes closest to the latter.

If the gemstones have a longitudinal direction in which the gemstones have their maximum dimension, the maximum position is the position in which the longitudinal direction is oriented vertically to the surface of the support body. In the minimum position, the longitudinal direction is inclined from the surface of the support body at a certain angle other than 90°, wherein, in the case of a curved surface, this angle relates to a tangential plane placed against the surface of the support body in the point in which the gemstone contacts the support body or comes closest to the latter.

The support body is an elongate body whose longitudinal dimension is many times greater than its cross-sectional perimeter. Preferably, the cross-sectional area is oriented at a right angle to the longest dimension of the support body. In a preferred alternative embodiment, the longitudinal dimension of the elongate support bodies (longest dimension of the support body) is greater by at least 0.1-fold or at least 1-fold or at least 2-fold, more preferably at least 4-fold, more preferably at least 10-fold, especially 15- to 10,000,000-fold, for example, 20- to 1,000,000-fold, than the perimeter of the cross-sectional area, which is formed at a right angle to such longitudinal dimension.

The elongate support body may be at least approximately a cylindrical or prismatic body, wherein especially cylinder-shaped bodies with a round cross-section and prismatic bodies with rectangular, square or triangular bases may be provided. The support body may further have a straight or curved design. In particular, the support body may have a flexible and/or hollow design. In the case of a flexible and hollow support body, it is a tubular support body. Support bodies in the form of a rope or flat tape are also possible.

The support body itself may be made of a plastic material, especially an elastic synthetic material. In principle, the material of the support body is not limited. For example, support bodies made of metal, wood and the like are also possible.

Because more than 60% of all gemstones are in a position in which the height of the gemstone relative to the surface of the support body is smaller than or equal to the arithmetic mean of the minimum height H min and the maximum height H max, a high degree of coverage of the support body with gemstones is possible. The position of the gemstones according to the invention corresponds to an orientation of the gemstones on the support body. The longitudinal direction (see above) of a gemstone comprises an angle with the surface of the support body that is below a limit. Preferably according to the invention, the limit of the angle of the longitudinal axis is less than 80°, preferably less than 70°, and more preferably less than 60°.

The high degree of coverage is obtained as a result of the oriented gemstones, wherein the adhesive layer between the gemstones can no longer be seen, or only hardly so, because of the high degree of coverage. This applies, in particular, for support bodies with a curved surface, such as support bodies having a round cross-section. The orientation of the gemstones and the resulting increased coverage is accompanied by a smoothing of the surface with a reduced surface roughness because of a reduced average roughness. This is considered aesthetically appealing and results in an improved wear comfort and a reduced risk of injury in a case where the decorative element is worn on the body, for example, as a bracelet or necklace. In addition, it has been found that detaching of gemstones is reduced in decorative elements according to the invention. This applies, in particular, for flexible support bodies.

The multitude of gemstones may be similar gemstones of equal size. However, it is also possible to use different kinds of gemstones, especially when the different kinds of gemstones are at least approximately at the same maximum height in their maximum position, whereby a very smooth surface can be formed even for different gemstones.

Further advantageous embodiments of the invention are defined in the dependent claims.

In one embodiment, more than 70%, preferably more than 80% and more preferably more than 90% of all gemstones are held at the support body in a position in which the height of the gemstone relative to the surface of the support body is smaller than or equal to the arithmetic mean of the minimum height and the maximum height.

In one embodiment, essentially all gemstones are held at the support body in a position in which the height of the gemstone relative to the surface of the support body is smaller than or equal to the arithmetic mean of the minimum height and the maximum height. The feature "essentially all gemstones" means that a two-sigma environment of the mean of the heights of the gemstones is below the arithmetic mean of the minimum height and the maximum height, or that a two-sigma environment of the mean of the angles of the longitudinal directions of the gemstones is below the limit that depends on the geometry of the gemstone.

In one embodiment of the invention, the adhesive layer has a layer thickness of from 5% to 60%, preferably from 10% to 40%, more preferably from 15% to 20%, of the maximum height of the gemstones. The layer thickness relates to the state before the gemstones are embedded. The kind of adhesive is not limited in principle. In particular, all adhesives that are solid at room temperature and soften when heated to about 70° C. are suitable. Thermoplastics, especially hotmelt adhesives, are preferred according to the invention. Thermoplastic polymers soften to form viscous liquids when heated, and resolidify when cooled down. Particularly preferred are reactive hotmelt adhesives, which are advantageous with respect to processing and curing properties. However, adhesives selected from the group of thermosets are also possible in principle. Preferably, it is provided that the adhesive is spread consistently on the whole surface of the support body.

In one embodiment of the invention, the support body is made of a flexible material, preferably a plastic material, wherein the support body may be hollow. An example of a flexible and hollow support body within the meaning of the invention is a flexible tube. The gemstones may be made of glass, preferably crystal glass. "Crystal glass" is to be understood as a glass covered by the Guideline of the Council of the European Communities 69/493/EEC. Decorative elements with such support bodies and gemstones have many applications. Merely by way of example, the use thereof as bracelets and necklaces or as handles for handbags may be mentioned.

In another embodiment of the invention, the size of the gemstones is below 10 mm, preferably from 1 mm to 6 mm, more preferably about 2 mm. The size of the gemstones is defined by their largest cross-sectional dimension. In a chaton-shaped gemstone with a back side converging to an apex and a front side bounded by a planar table, the largest cross-sectional dimension is provided in the dividing plane between the front and back sides. This also applies to gemstones having a front side converging to an apex and a back side converging to an apex. For double apexes, the cross-sectional dimension is mostly equal to the longitudinal dimension because of the manufacturing process. In gemstones whose front side is separated from the back side by a non-symmetrical cross-sectional area, the size of the gemstone is the maximum dimension of the cross-sectional area. An advantage of the process according to the invention resides in the fact that it may be employed, in particular, for small gemstones.

The gemstones may have a front side converging to an apex and an opposing back side converging to an apex, similar to a double-sided pyramid. Such gemstones are often referred to as double apex shapes, or double chatons if the front side and back side have equal designs. The longitudinal direction of such gemstones is defined by the connecting line of the two apexes.

In addition to double apex shapes, chaton-shaped gemstones also have a back side converging to an apex, and a converging front side, which is closed by a planar table, however. For gemstones with a converging backside and a converging front side, the region between the front side and back side is the region of the largest cross-sectional area, and the longitudinal direction of the gemstones is oriented perpendicularly to this cross-sectional area. The cross-sectional area may be bordered by an edge, but also by a two-dimensional rim, the so-called girdle. In the case of a girdle, a particularly comfortable wear sensation and a further reduced risk of injury are obtained. This applies, in particular, to gemstones in which the front side and back side are ground with facets, while the girdle is not ground.

In one embodiment of the invention, a multitude of essentially spherical decorative elements, preferably glass beads, are provided on the support body in addition to the above gemstones. Such decorative elements always have only one height and thus have no maximum height that would be different from a minimum height. In connec-tion with the gemstones, optically appealing effects are obtained.

In the process according to the invention, the gemstones are pressed into the adhesive layer using a pressure device, wherein the orientation of the gemstones with respect to the surface of the support body is effected during the pressing. Preferably, it is provided that the pressure device performs a movement parallel to the surface of the support body during the pressing of the gemstones. This improves the orientation of the gemstones.

The pressure device may be a stamp with one or more pressure plates that press the gemstones into the adhesive, or a roller by means of which the gemstones can also be pressed into the adhesive layer. In one embodiment, the pressure device can be moved during the pressing parallel to the surface of the support body. With a roller, the movement parallel to the surface of the support body is obtained from the rotation of the roller. In both cases, the parallelism relates to the region of the support body in which the gemstones are pressed by the pressure device into the adhesive layer. The movement of the pressure device is effected parallel to a tangential plane placed against the region of the surface of the support body in which pressure is exerted by the pressure device on the gemstones.

In a preferred embodiment, the stamp consists of at least two plates arranged in parallel by means of which the gemstones are pressed into the adhesive layer. This is of advantage, in particular, if the support body is to be covered with gemstones on opposing regions, or if the support body is one having a round cross-section. The opposing plates of the stamp can be moved in opposite directions parallel to the surface of the support body during the pressing of the gemstones. Further, it may be provided that the support body is rotated during the pressing of the gemstones.

Further details and advantages of the present invention are further illustrated in the following by means of the description of the Figures, making reference to the drawings, wherein.

Figure 7A:
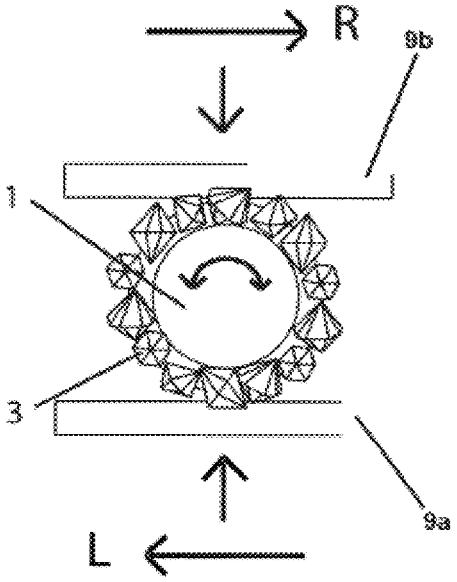
Figure 7B:
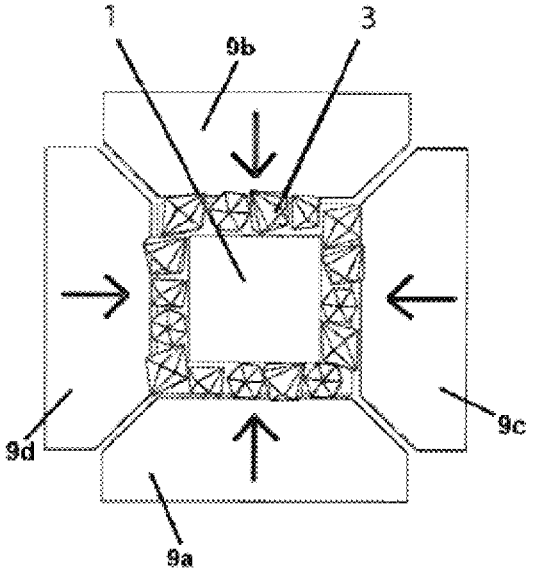
Figure 8A:
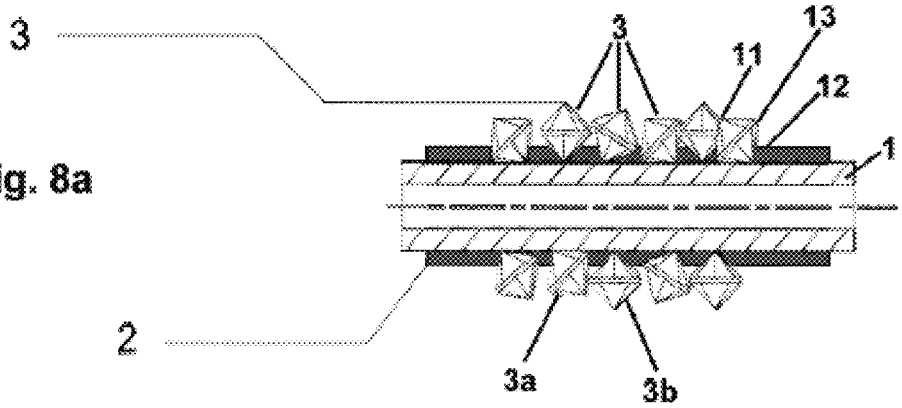
Figure 8B:
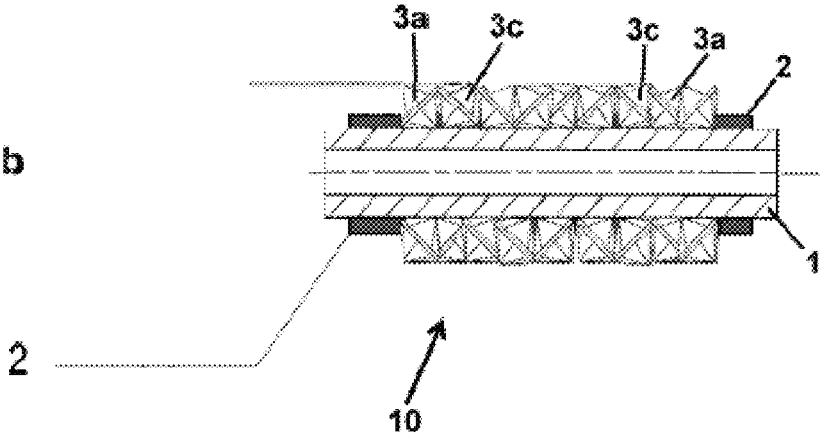
Figure 9:
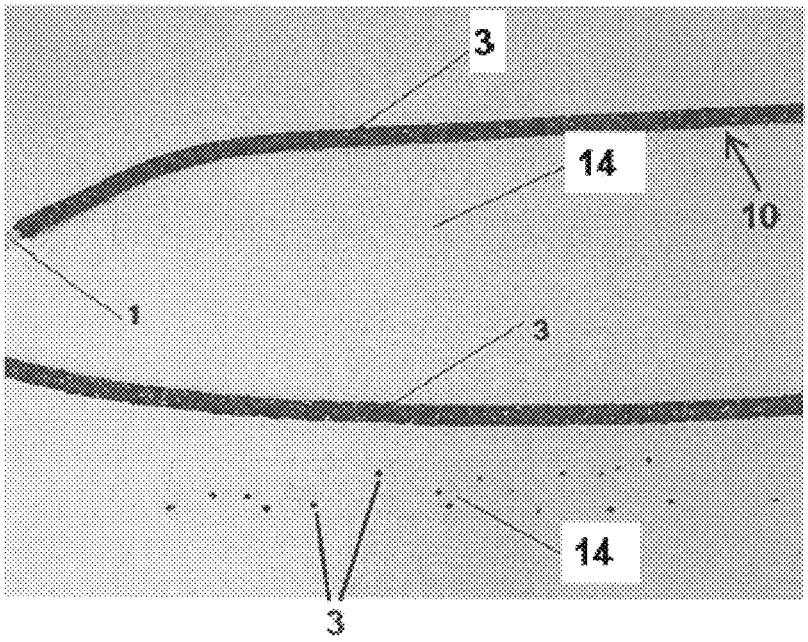
Figure 10:
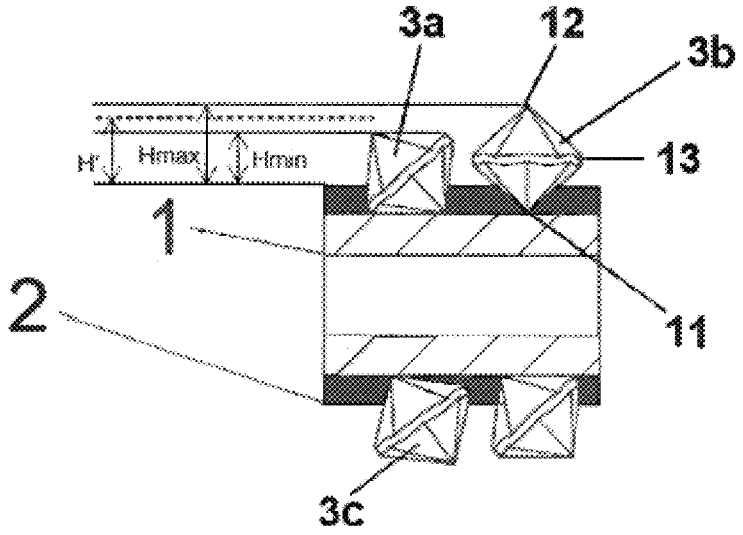

FIGS. 7*a* and 7*b* are schematic views of a third process step of the process according to the invention with different stamps;

FIGS. 8*a* and 8*b* are cross-sectional representations of a decorative element of the prior art and of a decorative element according to the invention;

FIG. 9 is a photographic representation for performing an experiment on the strength of the bonding between the gemstones and the adhesive layer; and FIG. 10 is a schematic representation for illustrating the minimum height and maximum height.

Figure 1:
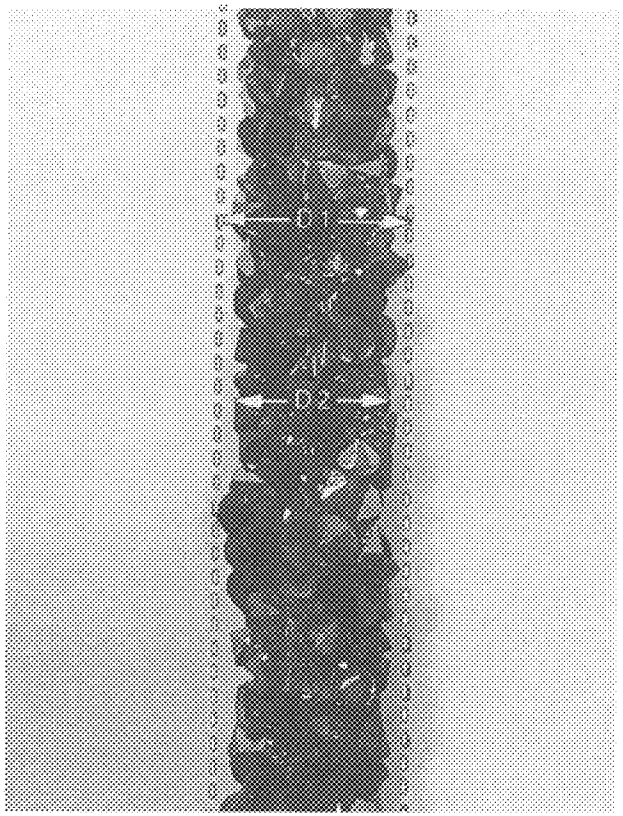
FIG. 1 is a photographic representation of a decorative element of the prior art.

FIG. 1 is a photographic representation of a decorative element of the prior art in which a multitude of gemstones 3 are unordered on a support body 1 by an adhesive layer 2, wherein the support body 1 is a cylindrical flexible tube with a diameter of 3 mm. The gemstones 3 are so-called double apex shapes consisting of a front side converging to an apex 11 and an opposing back side also converging to an apex 12. The gemstones are ground from a glass bead and have a longitudinal dimension of 2 mm. In the region of the largest cross-sectional dimension, which is also 2 mm, the gemstones 3 are bordered by a girdle. Because of the disorderly distribution of the gemstones 3, the latter adopt a wide variety of randomly distributed positions with respect to the surface of the support body 1. In particular, there are gemstones 3 that are oriented vertically to the surface of the support body, based on a tangential plane at the place of the gemstone 3, and thus are at a maximum height H max. An imaginary wrapping cylinder around the decorative element of the prior art has a diameter D1 of 7.37 mm. As can be seen from the diameter D2 of 6.39 mm, there are also occasional gemstones 3 in approximately minimum position 3*a*, which closely fit to the surface of the support body 1, in the decorative element according to the prior art (FIG. 1). However, such gemstones alternate with gemstones that are in approximately in their maximum position, so that all in all a rough surface with large leaps across the longitudinal direction, and a correspondingly large roughness, are obtained. In this Example, the adhesive layer 2 has a layer thickness of 0.3 mm before the gemstones are embedded.

Figure 2:
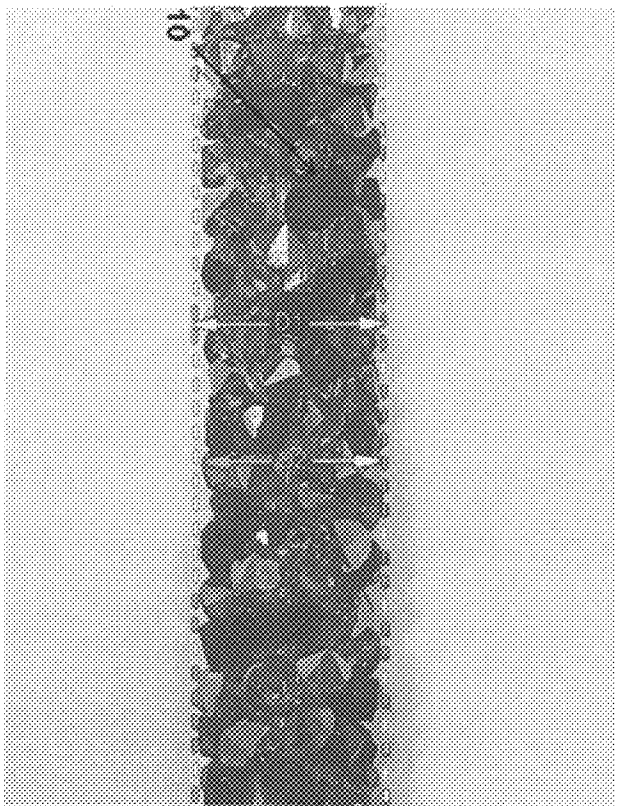
FIG. 2 is a photographic representation of a decorative element according to the invention.

FIG. 2 shows a decorative element 10 according to the invention. The support body 1 has the same dimensions as that of the decorative element according to FIG. 1, wherein the adhesive layer 2 is distributed on the surface of the support body 1 in the same thickness as in FIG. 1. Also, the gemstones 3 correspond to those of the decorative element according to FIG. 1. In contrast to the prior art (FIG. 1), the gemstones 3 have been oriented in such a way that their longitudinal direction defined by the connecting line of apexes 11 and 12 is no longer oriented vertically to the surface of support body 1. Rather, more than 90% of all gemstones 3 are in a position 3*c* in which they are at a height H relative to the surface of the support body 1 that is smaller than the arithmetic mean of the maximum height H max and the minimum height H min. In the Example shown, a wrapping cylinder with a diameter D1 of 6.48 mm is thereby obtained. In particular, the surface is clearly smoother with a highly reduced average roughness as compared to the Example shown in FIG. 1. As can be seen from the diameter D2 of 6.24 mm (FIG. 2), the so-called minimum diameter D2 of the decorative element 10 deviates only relatively slightly from the diameter D2 of 6.39 mm in FIG. 1. However, the deviation of the minimum diameter D2 (6.24 mm, FIG. 2) from diameter D1 (6.48 mm, FIG. 2) is much smaller than the deviation obtained in the prior art, i.e., the deviation of D2 (6.39 mm, FIG. 1) from D1 (7.37 mm, FIG. 1).

Figure 3:
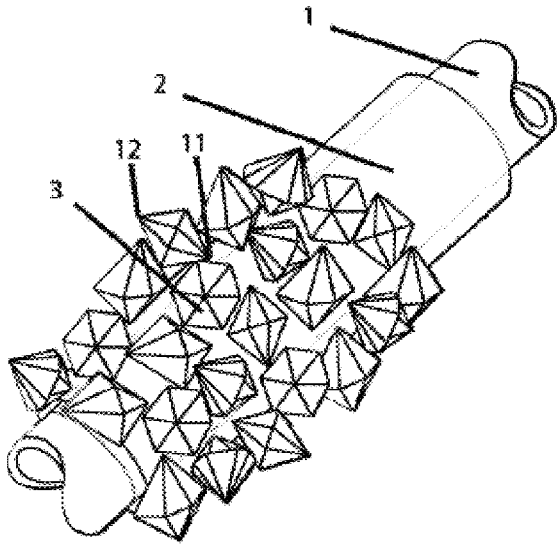
FIG. 3 is a perspective detailed view of a decorative element of the prior art.

FIG. 3 is a perspective detailed view of a decorative element of the prior art. It is easily recognized that the tube-shaped support body 1 is surrounded by a continuous and uniform adhesive layer 2, which holds the gemstones 3 in disorderly distribution. The gemstones are double apex shapes with opposing apexes 11 and 12. Because of the disorderly distribution, an uncomfortable wear sensation and an increased risk of injury are obtained, and the risk that gemstones 3 are detached from the decorative element is high, especially if the support body is flexible and is bent when used.

Figure 4:
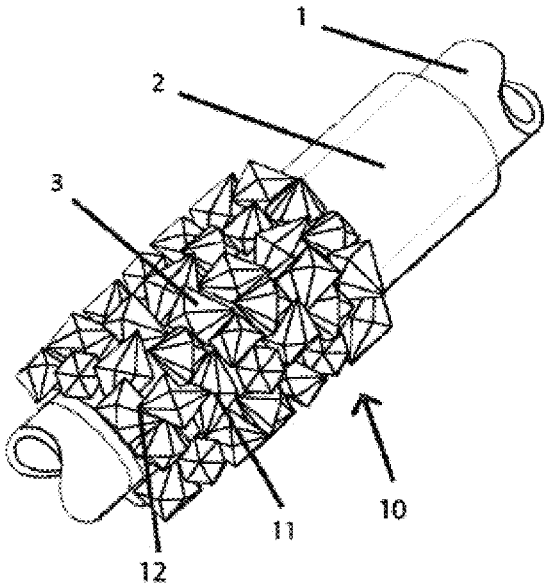
FIG. 4 is a perspective detailed view of a decorative element according to the invention.

FIG. 4 shows a decorative element 10 according to the invention in a perspective detailed view, wherein a continuous and uniform adhesive layer 2 is again provided on a tube-shaped support body 1. More than 60% of gemstones 3 are oriented according to the invention and therefore result in a high degree of coverage with a smoother surface, which is accompanied by an improved wearing sensation and a lower risk of injury, for example, in the case of a bracelet or a necklace. In addition, the risk of detachment of gemstones 3 from the decorative element 10 is clearly reduced.

Figure 5:
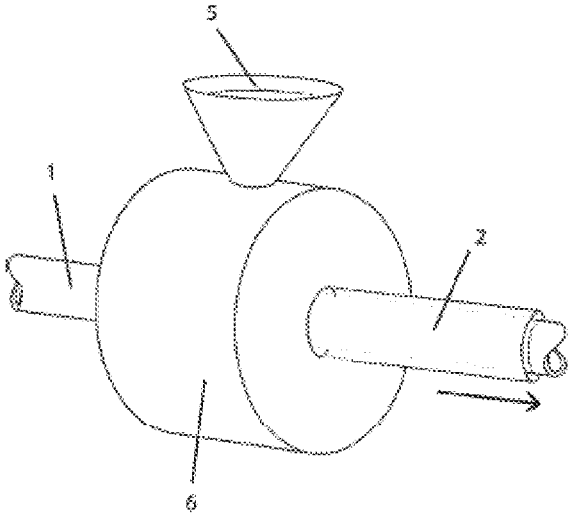
FIG. 5 is a schematic view of a first process step of the process according to the invention.

FIG. 5 shows a first process step of the process according to the invention, wherein the surface of a tube-shaped support body 1 is consistently provided with an adhesive layer 2, whose thickness depends on the size of support body 1 and on the size of the gemstones 3 to be applied. For example, the layer thickness of adhesive layer 2 is from 0.2 mm to 0.3 mm.

In this Example, heated liquid hotmelt adhesive 2 is fed through a supply device 5 to an application nozzle 6, from which as uniform an adhesive application as possible is achieved on the surface of the support body 1 to achieve optimum embedding of gemstones 3.

Figure 6:
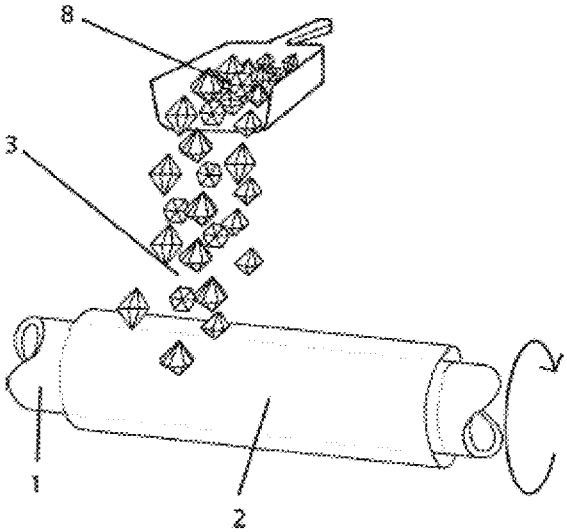
FIG. 6 is a schematic view of a second process step of the process according to the invention.

FIG. 6 shows another process step in which the gemstones 3 are applied from a storage container 8 in random distribution to the adhesive layer 2 while still hot. In the Example shown, the application is effected by sprinkling. The support body 1 is rotated around its longitudinal axis in order to achieve a more uniform covering by the gemstones 3. This type of application is particularly favorable for support bodies with a curved surface, for example, rope-shaped ones. During the application of the gemstones 3, the adhesive 2 is no longer liquid, but it is still viscous to some extent, in order that the gemstones 3 can be impressed into the adhesive layer 2 in another process step.

FIGS. 7*a* and 7*b* show how the gemstones 3 are pressed into the adhesive layer 2 using a pressure device in the form of a stamp 9, wherein the orientation of the gemstones 3 with respect to the surface of the support body 1 is changed during the pressing.

In FIG. 7*a*, the stamp 9 consists of two opposing elastic plates 9*a* and 9*b*. The plates 9*a*, 9*b* move towards one another and towards the support body 1 while the adhesive 2 is still hot, whereby pressure is exerted on the gemstones 3, and the gemstones 3 are embedded in the adhesive layer 2, whereby essentially all the gemstones 3 are oriented and compacted and are in a position in which the height H of the gemstones 3 with respect to the surface of the support body 1 is low. In this Example, plates 9*a*, 9*b* move parallel to the surface of the support body 1 during the pressing, whereby the orientation of gemstones 3 is further improved. In this embodiment, it is provided that both plates 9*a*, 9*b* move parallel to the surface of the support body 1, and it is further provided that the two plates 9*a*, 9*b* are moved in opposite directions R, L. Further, the support body 1 can be rotated during the pressing of the gemstones 3. Such a stamp 9 is employed, in particular, for support bodies 1 having a round cross-section.

FIG. 7*b* shows another embodiment of the stamp 9 in which two pairs of respective-ly opposing plates 9*a*, 9*b*, 9*c*, 9*d* are provided, which press the gemstones 3 into the adhesive layer 2 and thereby orient them. This stamp is employed, in particular, for support bodies 1 having a rectangular cross-section.

FIG. 8*a* shows a cross-sectional representation of a decorative element of the prior art in which the gemstones 3 are distributed in an unordered manner and therefore are in a wide variety of randomly distributed positions with respect to the surface of the support body 1. The gemstones 3 correspond to those of FIGS. 1 and 2. In particular, there are gemstones 3 in a maximum position 3*b* in which they are oriented vertically to the surface of the support body, based on a tangential plane at the place of the gemstone 3, and thus are at a maximum height H max. There are also occasional gemstones 3 in a minimum position 3*a*, in which the gemstones 3 rest on the surface of the support body 1 with a lateral boundary line of the front side or with the backside, and their longitudinal direction is inclined at an angle of 45° relative to the surface of the support body, thus being at a minimum height H min. This state is obtained after the adhesive layer 2 and subsequently the gemstones 3 have been applied to the support body 1 in a random distribution, and thus corresponds to a decorative element of the prior art.

After the gemstones 3 have been oriented under pressure, the decorative element 10 as shown in the cross-sectional representation according to FIG. 8*a* is obtained. More than 90% of all gemstones 3 are in a position 3*c* in which they are at a height H relative to the surface of the support body 1 that is smaller than the arithmetic mean of the maximum height H max and the minimum height H min. A large number of gemstones 3 are even approximately in the minimum position 3*a*. The clearly reduced surface roughness with a smoothed surface and a high degree of coverage as a consequence of the gemstones 3 having been oriented under pressure can be recognized. A substantially higher adherence between the gemstones 3 and the support body 1, an increased degree of coverage and a perceptibly more uniform surface of the decorative element 10 are achieved thereby. This holds, in particular, for support bodies 1 with a curved surface, such as tubular support bodies.

FIG. 9 shows an experiment to represent the higher bond strength of the gemstones 3 in a decorative element 10 according to the invention. In a tape test for testing the adhesive strength of the gemstones 3, a piece of adhesive tape 14 of the type 3M VHB™ Tape 4910F Acrylic Foam of about 7 cm length is bonded onto a clean region of decorative element 10 that is free of contaminations, and the protective film of the adhesive tape 14 is peeled off. Subsequently, a pressure is exerted on the decorative element for some seconds. Thereafter, the decorative element 10 is peeled off the adhesive tape at an angle of about 90° with a quick movement. For testing the adhesive strength of the gemstones 3, it is tested how many gemstones 3 remain adhered to the adhesive tape 14 after the decorative element has been peeled off. As can be seen from FIG. 9, a large number of gemstones 3 remain adhered to the adhesive tape 14 in the decorative element of the prior art as shown on the lower part. In contrast, in the case of the decorative element 10 according to the invention as shown on the upper part of FIG. 9, no gemstones 3 remain adhered to the adhesive tape 14. Thus, the decorative elements according to the invention exhibit a clearly better adherence.

In a schematic representation, FIG. 10 shows an enlarged section of the decorative element shown in FIG. 8*a*. The gemstones are double apex shapes whose front side and back side converge to apexes 11 and 12 and are separated by a girdle 13. The front side and back side are equally designed and faceted. The top left gemstone 3 is in a minimum position 3*a*, in which the front side or back side with the lateral boundary line rests on the outer surface of the support body 1. The height H min is obtained from the maximum of all normal distances of the gemstone with respect to the surface of support body 1. Since the represented support body 1 is a hollow cylinder, the normal distance is based on a tangential plane of the surface of the support body 1. In the present case, this tangential plane is oriented vertically to the drawing plane. The top right gemstone 3 is in a maximum position 3*b*, in which the longitudinal direction of gemstone 3 as defined by the line connecting the apexes 11 and 12 is oriented vertically to the surface of support body 1. In the maximum position 3*b*, the height H of the gemstone is the maximum height H max. The dashed line represents the arithmetic mean H' of the maximum height H max and the minimum height H min. According to the invention, at least more than 60% of gemstones 3 are in a position 3*c* in which the height H is smaller than or equal to the arithmetic mean H'.

The invention claimed is:

1. A decorative element, comprising an elongate support body, and a multitude of faceted gemstones, on an adhesive layer on the support body, wherein a minimum position and a maximum position relative to a surface of the support body exist for each of the gemstones, characterized in that more than 60% of the gemstones are kept in a position in which the height of the gemstone relative to the surface of the support body is smaller than or equal to the arithmetic mean of the height Hmin in the minimum position and the height Hmax in the maximum position.

2. The decorative element according to claim 1, wherein more than 70% of the gemstones are kept in a position in which the height of the gemstone relative to the surface of the support body is smaller than or equal to the arithmetic mean of the height Hmin in the minimum position and the height Hmax in the maximum position.

3. The decorative element according to claim 1, wherein said adhesive layer has a layer thickness of from 5% to 60% based on the height Hmax of the gemstones in the maximum position, before the gemstones are embedded.

4. The decorative element according to claim 1, wherein said support body is made of a flexible material and/or said gemstones are made of glass.

5. The decorative element according to claim 1, wherein said support body is hollow.

6. The decorative element according to claim 1, wherein said gemstones have a front side converging to an apex and an opposing back side con-verging to an apex.

7. The decorative element according to claim 6, wherein said back side is separated from said front side by a girdle.

8. The decorative element according to claim 1, wherein the size of the gemstones is smaller than 10 mm.

9. The decorative element according to claim 1, wherein spherical decorative elements are provided on the adhesive layer in addition to the gemstones.

10. The decorative element according to claim 1, wherein said adhesive is selected from a group of thermoplastics.

11. A process for producing a decorative element according to claim 1, the process comprising the following steps:

(a) applying an adhesive layer to the surface of the support body;

(b) distributing a multitude of gemstones on the surface of the support body;

characterized in that the gemstones are pressed into the adhesive layer using a pressure device, whereby an orientation of the gemstones with respect to the surface of the support body is effected; and wherein said pressure device performs a movement parallel to the surface of the support body during the pressing of the gemstones.

12. The process according to claim 11, wherein said pressure device comprises a stamp of at least two plates arranged in parallel by means of which the gemstones are pressed into the adhesive layer.

13. The process according to claim 12, wherein said parallel plates of the stamp are moved in opposite directions parallel to the surface of the support body during the pressing of the gemstones.

14. The process according to claim 11, wherein said support body is rotated around its longitudinal axis during the pressing of the gemstones.

15. The decorative element according to claim 2, wherein more than 90% of the gemstones are kept in a position in which the height of the gemstone relative to the surface of the support body is smaller than or equal to the arithmetic mean of the height Hmin in the minimum position and the height Hmax in the maximum position.

16. The decorative element according to claim 3, wherein said adhesive layer has a layer thickness of from 15% to 20%, based on the height Hmax of the gemstones in the maximum position, before the gemstones are embedded.

17. The decorative element according to claim 4, wherein said support body is made of a plastic material and/or said gemstones are made of crystal glass.

18. The decorative element according to claim 8, wherein the size of the gemstones is from 1 mm to 6 mm.

19. The decorative element according to claim 9, wherein the spherical decorative elements are glass beads.

20. The process according to claim 12, wherein the plates are elastic.

* * * * *